US008857222B2

(12) United States Patent
Hong

(10) Patent No.: US 8,857,222 B2
(45) Date of Patent: Oct. 14, 2014

(54) WASHING MACHINE

(75) Inventor: Kyung Seop Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 991 days.

(21) Appl. No.: 12/990,154

(22) PCT Filed: Apr. 27, 2009

(86) PCT No.: PCT/KR2009/002179

§ 371 (c)(1),
(2), (4) Date: Nov. 5, 2010

(87) PCT Pub. No.: WO2009/134037

PCT Pub. Date: Nov. 5, 2009

(65) Prior Publication Data

US 2011/0036128 A1 Feb. 17, 2011

(30) Foreign Application Priority Data

Apr. 29, 2008 (KR) ..... 10-2008-0040026

(51) Int. Cl.
*D06F 37/20* (2006.01)
*D06F 37/22* (2006.01)

(52) U.S. Cl.
CPC ..... *D06F 37/22* (2013.01)
USPC ..... 68/12.19; 68/23.1; 68/140

(58) Field of Classification Search
USPC ..... 68/12.07, 12.19, 23.1, 23.3, 84, 140
See application file for complete search history.

(56) References Cited

FOREIGN PATENT DOCUMENTS

| | | |
|---|---|---|
| JP | 09-024186 | 1/1997 |
| JP | 2006026408 | 2/2006 |
| JP | 2007252940 | 4/2007 |
| KR | 1020050052311 A | 8/2005 |
| KR | 10-0664070 | 12/2006 |

OTHER PUBLICATIONS

Korean Intellectual Property Office English language translation of Kim et al. KR 10-0664070, examined publication date Jan. 3, 2007.*
Korean Intellectual Property Office English language translation of Gon Kim KR 10-1082568, publication date Jun. 7, 2006, examined publication date Nov. 10, 2011.*

* cited by examiner

*Primary Examiner* — Alex Noguerola
(74) *Attorney, Agent, or Firm* — McKenna Long & Aldridge LLP

(57) ABSTRACT

A washing machine including a vibration reduction member formed in a stator is provided. Therefore, when a motor rotates according to operation of the washing machine, delivery of a vibration due to a repulsive force of the stator to a bearing housing can be efficiently reduced. Further, a vibration of a tub fastened to the bearing housing due to the vibration is prevented and noise due to the vibration of the tub is reduced.

16 Claims, 8 Drawing Sheets

WASHING MACHINE

CROSS-REFERENCE TO RELATED APPLICATION

This application is a 35 U.S.C. §371 U.S. National Stage entry of International Application No. PCT/KR2009/002179, filed Apr. 27, 2009, which claims the benefit of earlier filing date and right of priority to Korean Application No. 10-2008-000040026, filed on Apr. 29, 2008, the contents of which are incorporated by reference herein in their entirety.

BACKGROUND

1. Technical Field

The present invention relates to a washing machine, and more particularly, to a washing machine for reducing a vibration of a stator to be delivered to a tub.

2. Background Art

A drum of a washing machine receives the rotary power by a motor to process the laundry. As a stator is directly connected to a tub, a vibration of the stator is delivered to the tub. Therefore, when operating the washing machine, noise occurs due to the vibration. Particularly, in a conventional washing machine, as a stator is directly fastened to a bearing housing insert-injected and fixed to the tub, a vibration is not effectively reduced.

BRIEF SUMMARY

The present invention has been made in an effort to solve the above problems, and the present invention provides a washing machine that can reduce noise of a tub due to a vibration as the vibration of a stator is delivered to the tub.

According to an aspect of the present invention, there is provided a washing machine including: a motor including a stator and a rotor; a drum for driving by a rotation axis of the rotor; a tub for defining a space at which the drum is disposed; a bearing housing fixed to the tub and for housing bearings supporting the rotation axis of the rotor, wherein the stator includes: a body; a vibration reduction member formed in the body and coupled to the bearing housing for reducing a vibration delivered from the body to the tub, wherein the vibration reduction member includes: a plurality of bearing couplers fastened to the bearing housing to support the stator; and a plurality of deforming parts disposed between the bearing couplers to connect the bearing couplers and for reducing a vibration by being deformed.

According to another aspect of the present invention, there is provided a washing machine including: a motor including a stator and a rotor; a drum for driving by a rotation axis of the rotor; a tub for defining a space at which the drum is disposed; a bearing housing fixed to the tub and for housing bearings supporting the rotation axis of the rotor, wherein the stator includes: a body; a vibration reduction member extended from the body to be integrally formed with the body and to be deformed due to a load of the stator.

BRIEF DESCRIPTION OF DRAWINGS

The present invention will become more fully understood from the detailed description given herein below and the accompanying drawings, which are given by illustration only, and thus are not limitative of the present invention, and wherein.

DETAILED DESCRIPTION

Hereinafter, exemplary embodiments according to the present invention will be described in detail with reference to the accompanying drawings.

Figure 1:
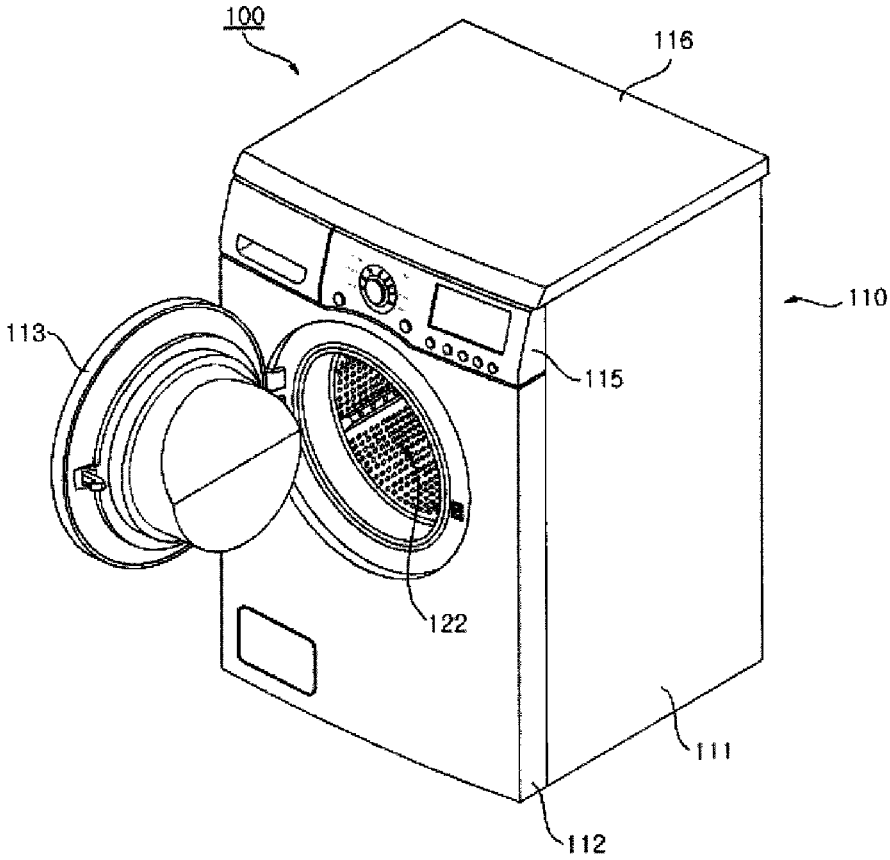
FIG. 1 is a perspective view illustrating a washing machine according to an exemplary embodiment of the present invention.

FIG. 1 is a perspective view illustrating a washing machine 100 according to an exemplary embodiment of the present invention.

Referring to FIG. 1, the washing machine 100 includes a cabinet 110, a laundry washing unit (not shown) disposed within the cabinet 110 for washing the laundry, a washing water supply device (not shown) for injecting washing water to the laundry washing unit, and a drainage device (not shown) for discharging the washing water to the outside after washing is terminated in the laundry washing unit.

The cabinet 110 includes a cabinet main body 111, a cabinet cover 112 disposed at a front surface of the cabinet main body 111 to be coupled to the cabinet main body 111, a control panel 115 disposed at one side of the cabinet cover 112 and for determining an operating state of the washing machine 100, and a top plate 116 disposed at an upper part of the control panel 115 to be fastened to the cabinet main body 111. The cabinet cover 112 includes a laundry inlet hole (not shown) for inserting the laundry into the drum 122, and a door 113 rotatably fastened to the cabinet cover 112 to open and close the laundry inlet hole.

Figure 2:
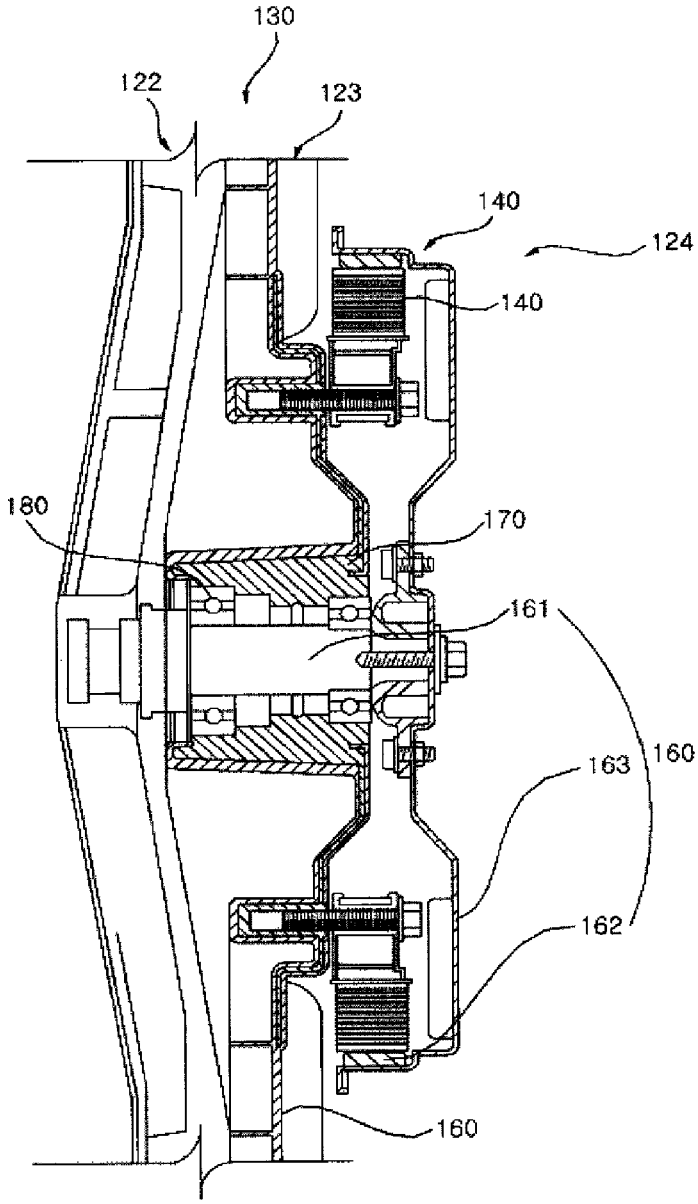
FIG. 2 is a partial cross-sectional view illustrating a laundry washing unit of the washing machine of FIG. 1.

FIG. 2 is a partial cross-sectional view illustrating a laundry washing unit 130 of the washing machine 100 of FIG. 1.

Referring to FIG. 2, the laundry washing unit 130 includes a drum 122 for inserting and washing the laundry, a tub 123 for defining a space at which the drum 122 is disposed, and a driver 124 for generating a driving force to deliver the rotary power to the drum 122. The driver 124 includes a driving device 140 for generating a driving force, bearings 180 for supporting a driving force occurring in the driving device 140, and a bearing housing 170 for inserting the bearings 180 into the bearing housing 170 to support the bearings 180.

The driving device 140 is a means for delivering a driving force to the drum 122 and may be variously formed. Hereinafter, a motor 140 is described as an example of the driving device 140. The motor 140 includes a stator 150, and a rotor 160 for generating a driving force by an electromagnetic force occurring between the stator 150 and the rotor 160. The rotor 160 includes a rotor frame 163 for enclosing the outside of the stator 150, a rotor magnet 162 disposed at an inner circumferential surface of the rotor frame 163 for rotating by an electric force occurring in the stator 150, and a rotation axis 161 for delivering the rotary power occurring by a rotation of the rotor magnet 162 to the drum 122.

Figure 3:
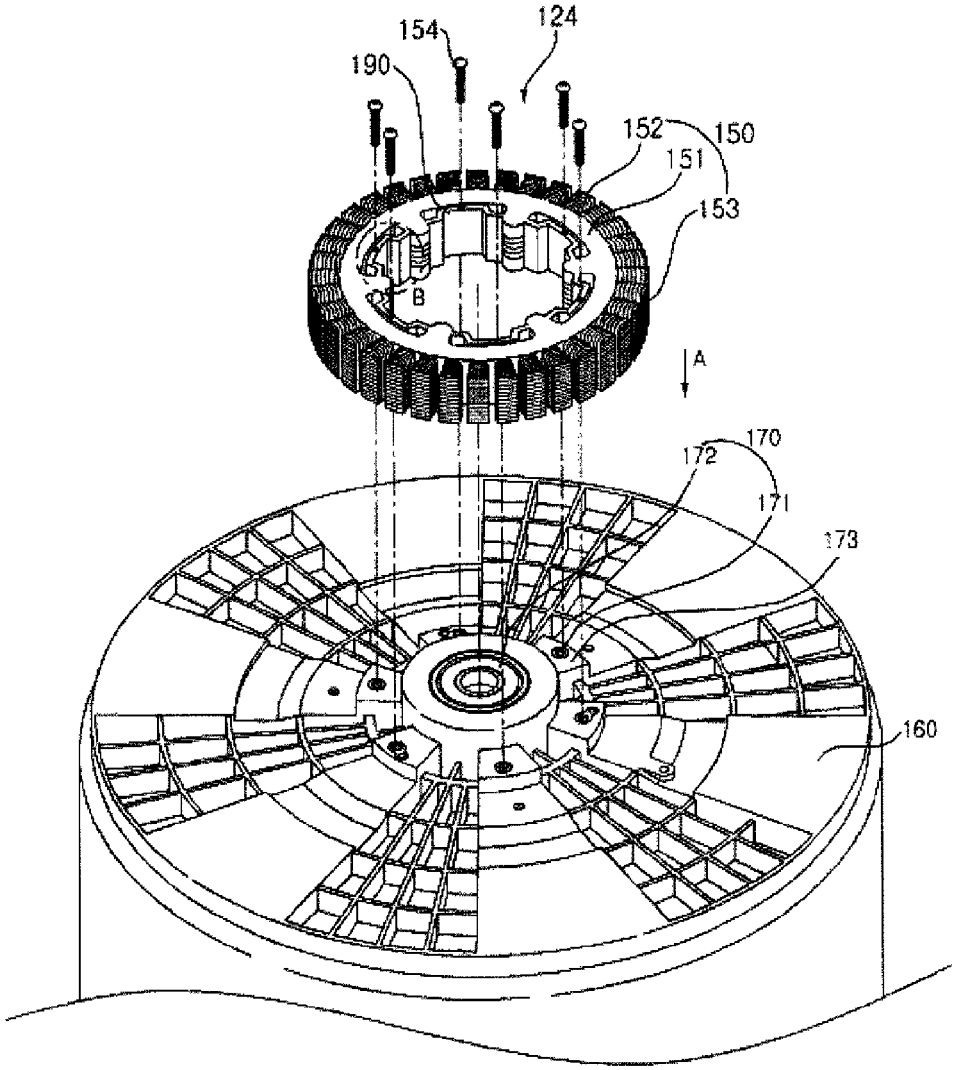
FIG. 3 is a perspective view illustrating a coupling order of the laundry washing unit of FIG. 2.
Figure 4:
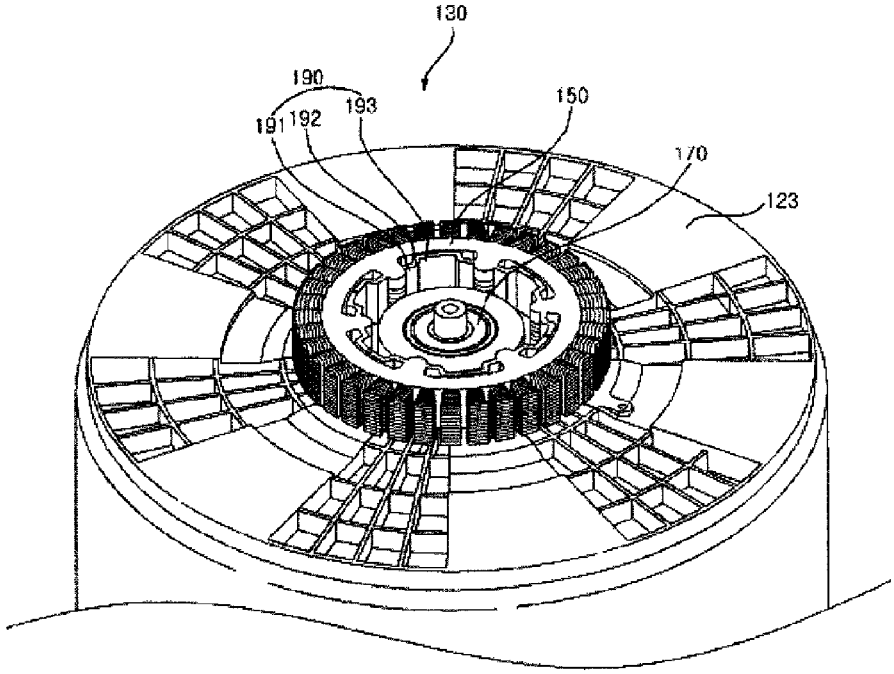
FIG. 4 is a perspective view illustrating a coupled shape of the laundry washing unit of FIG. 3.

FIG. 3 is a perspective view illustrating a coupling order of the laundry washing unit 130 of FIG. 2, and FIG. 4 is a perspective view illustrating a coupled shape of the laundry washing unit 130 of FIG. 3.

Referring to FIGS. 3 and 4, the stator 150 includes a coil 152 for generating an electromagnetic force, a body 151 for fixing the coil 152, and a vibration reduction member 190 formed in the body 151 to be coupled to the bearing housing 170 and for reducing a vibration delivered from the body 151 to the tub 123. The bearing housing 170 includes a bearing support 172 insert-injected to a rear wall of the tub 123 for supporting the bearings 180 and a stator fixing part 173 extended in a radial direction from the bearing support 172 to be coupled to the stator 150. The vibration reduction member 190 includes a plurality of bearing couplers 193 fastened to the bearing housing 170 to support the stator 150, and a plurality of deforming parts 191 disposed between the bearing couplers 193 to connect the bearing couplers 193 and for reducing a vibration by being deformed. The vibration reduction member 190 is integrally formed with the body 151.

The bearing housing 170 is fixed to the tub 123. The bearing housing 170 is fixed to the tub 123 with various methods. In the present exemplary embodiment, a case where the bearing housing 170 is insert-injected to the tub 123 is described. However, the following description is an exemplary embodiment of the present invention and the present invention is not limited thereto.

A vibration reduction member coupling hole 171 of the fixed bearing housing 170 is exposed to the outside of the tub 123. The bearing support 172 of the bearing housing 170 is also exposed to the outside of the tub 123. The stator 150 is fastened to the bearing housing 170 in a direction A. The bearing couplers 193 of the vibration reduction member 190 are fastened by a fastening member 154 and the vibration reduction member coupling hole 171 disposed at the outside of the tub 123.

Figure 5:
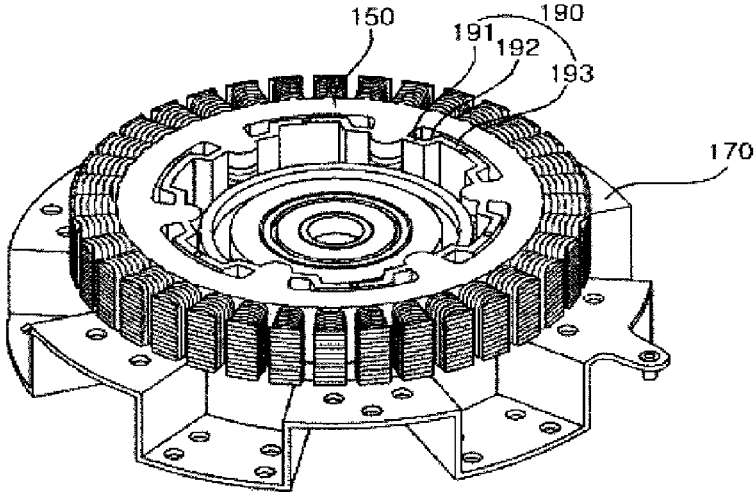
FIG. 5 is a perspective view illustrating a coupled shape of a stator and a bearing housing of FIG. 4.

FIG. 5 is a perspective view illustrating a coupled shape of the stator 150 and the bearing housing 170 of FIG. 4.

Referring to FIG. 5, the bearing housing 170 is insert-injected and fixed to a tub (not shown). In FIG. 5, the tub is omitted, and a coupling order of the bearing housing 170 and the stator 150 is described. The bearing housing 170 is fastened and fixed to the vibration reduction member 190. The bearing housing 170 is fastened to the vibration reduction member 190 through a plurality of vibration reduction member coupling holes 171 formed at one side of the bearing housing 170. The vibration reduction member 190 includes bearing couplers 193 for being fastened to the vibration reduction member coupling holes 171. The vibration reduction member coupling holes 171 are fastened and fixed to the bearing couplers 193, respectively, by a coupling member (not shown). The vibration reduction member 190 has a bent portion to reduce a vibration occurring in the stator 150.

In a coupling order of the stator 150 and the bearing housing 170, the stator 150 is coupled from the upside of the bearing housing 170. The stator 150 is fastened to the bearing housing 170 by a coupling member (not shown). The stator 150 includes the vibration reduction member 190, and the vibration reduction member 190 includes the plurality of bearing couplers 193. The bearing couplers 193 are fastened to a vibration reduction member coupler (not shown) formed in the bearing housing 170.

Figure 6:
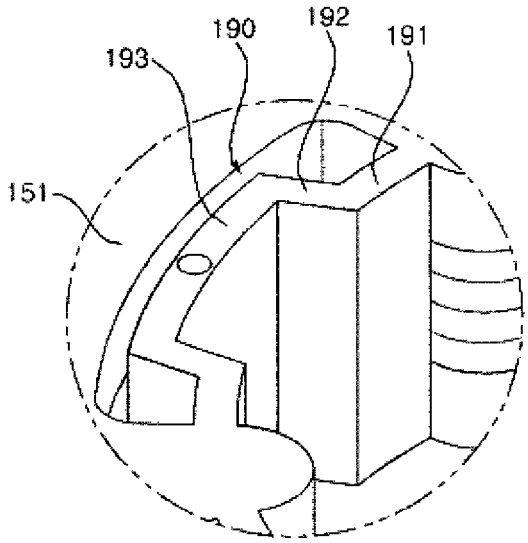
FIG. 6 is a partial perspective view illustrating a first example of a vibration reduction member of FIG. 5.

FIG. 6 is a partial perspective view illustrating a first example of the vibration reduction member 190 of FIG. 5.

Referring to FIG. 6, the vibration reduction member 190 includes a plurality of bearing couplers 193 fastened to a bearing housing (not shown) to support the stator 150, and a plurality of deforming parts 191 disposed between the bearing couplers 193 to connect the bearing couplers 193 and for reducing a vibration by being deformed. Further, the vibration reduction member 190 is integrally formed with the body 151. The bearing couplers 193 and the plurality of deforming parts 191 of the vibration reduction member 190 are integrally formed.

Each deforming part 191 includes connection parts 192 extended in a two-way from the bearing coupler 193 and connected to adjacent deforming parts 191. Further, the connection parts 192 are extended by bending from the bearing coupler 193 and are coupled to bend from the deforming parts 191. The plurality of deforming parts 191 and the plurality of bearing couplers 193 are separated by a predetermined gap. Each bearing coupler 193, each connection part 192, and each deforming part 191 are disposed on the same plane. Thereby, a vibration occurring in the stator 150 is effectively reduced while being delivered through the connection parts 192. Because the reduced vibration is not easily delivered to the tub 123, noise due to a vibration of the tub 123 is reduced.

The present invention is not limited thereto. Each connection part 192 is coupled to each deforming part 191 or each bearing coupler 193 at a predetermined angle. Further, the predetermined angle is substantially a right angle. The predetermined angle is not limited to a right angle and includes all angles that can reduce a vibration occurring in the stator by experimentation.

Further, the vibration reduction member 190 is formed on a plane different from that of the body 151. That is, the vibration reduction member 190 may be formed lower than or higher than the body 151. As the vibration reduction member 190 and the body 151 is disposed on a plane different from that of the body 151, a vibration can be effectively reduced. Further, the bearing couplers 193 of the vibration reduction member 190 can be disposed on a plane different from that of the body 151. When the bearing couplers 193 are disposed on a plane different from that of the body 151, bent portions of the connection parts 192 and the deforming parts 191 are extended to different planes.

Figure 7:
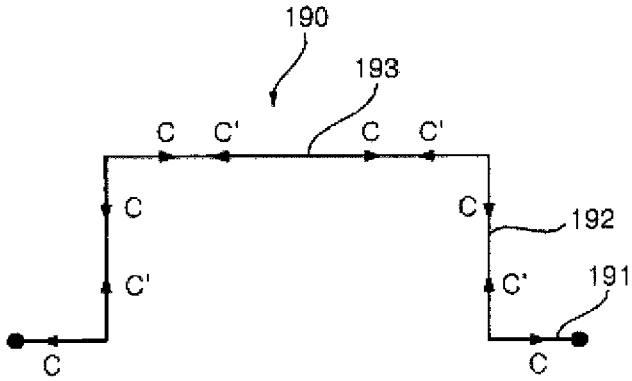
FIG. 7 is a conceptual diagram illustrating a vibration of the vibration reduction member of FIG. 6.

FIG. 7 is a conceptual diagram illustrating a vibration of the vibration reduction member 190 of FIG. 6.

Referring to FIG. 7, when the washing machine 100 starts operation, a motor (not shown) is driven. When the motor is driven, a current is applied to a coil (not shown) of the stator 150. The stator 150 generates an electric force by the applied current. A magnet rotates by a magnetic force occurring in the magnet disposed at the outside of the stator 150, thereby rotating a rotation axis (not shown). When the rotation axis rotates, the drum rotates by the rotary power of the rotation axis. When the motor is driven, a vibration occurs by a repulsive force of the stator 150. The vibration is delivered to the stator 150, and the stator 150 vibrates. A vibration of the stator 150 is delivered to the tub 123. In coupling of a conventional stator and tub, the tub and a body of the stator are directly fastened. Therefore, when the conventional stator vibrates, the vibration is delivered to the tub through a coupling portion of the conventional stator and tub. By the delivered vibration, the tub vibrates and noise occurs. However, the stator 150 according to the present exemplary embodiment is directly fastened to the tub 123, however the stator 150 is fastened to the tub 123 through the vibration reduction member 190. The vibration reduction member 190 is fastened to a bearing housing (not shown) by the bearing housing coupler 193. When the stator 150 vibrates, the vibration is again delivered from the stator 150 to the vibration reduction member 190. The vibration is delivered to the bearing housing through the vibration reduction member 190. The delivered vibration is finally delivered to the tub 123. The tub 123 is vibrated by the vibration.

The vibration reduction member 190 is extended from a body (not shown) and is fastened to the bearing housing. Further, the connection parts 192 are bent from the deforming parts 191 and are connected to the bearing couplers 193. Therefore, a vibration collides with a bent portion of the connection parts 192 after advancing in a direction C, and the bent portion forms a reflected wave of a vibration of a direction C in a direction C'. The vibration of the direction C is weakened by a reflected wave of the direction C'. Thereby, the remarkably reduced vibration is delivered to the tub 123.

Figure 8:
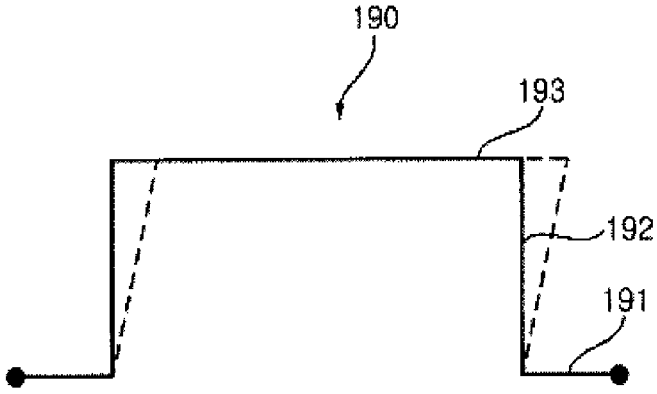
FIG. 8 is a conceptual diagram illustrating a modified example of a vibration of the vibration reduction member of FIG. 6.

FIG. 8 is a conceptual diagram illustrating a modified example of a vibration of the vibration reduction member 190 of FIG. 6.

In FIG. 8, constituent elements identical to or corresponding to those according to the foregoing exemplary embodiment are denoted by the same reference numerals and therefore a detailed description thereof is omitted, and only dissimilar constituent elements are described here in detail.

Referring to FIG. 8, the vibration reduction member 190 includes a bearing coupler 193 fastened to a bearing housing (not shown), connection parts 192 disposed between bodies (not shown) to connect the bearing coupler 193, and deforming parts 191 extended from the connection parts 192. When a vibration occurs in the motor, the vibration is delivered to the stator 150. The delivered vibration is delivered to the vibration reduction member 190. The vibration delivered to the vibration reduction member 190 is delivered to the bearing housing. Due to the vibration, the tub 123 vibrates in a vibration direction about the plurality of bearing couplers 193. While the vibration advances, the vibration reduction member 190 acts a restoring force similarly to a leaf spring and reduces the vibration. Moreover, the vibration reduction member 190 consumes vibration energy by friction with air while vibrating. Further, due to deformation of the vibration reduction member 190, a vibration that should be delivered to the tub 123 is converted to vibration energy of the vibration reduction member 190 and is thereby not delivered to the tub 123. Therefore, a vibration delivered to the bearing coupler 193 is remarkably reduced.

Figure 9:
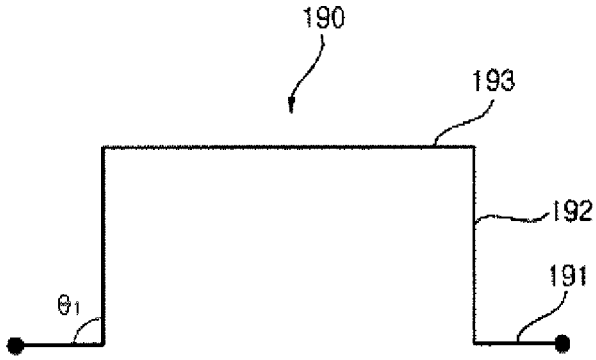
FIG. 9 is a conceptual diagram illustrating a shape of the vibration reduction member of FIG. 6.
Figure 10:
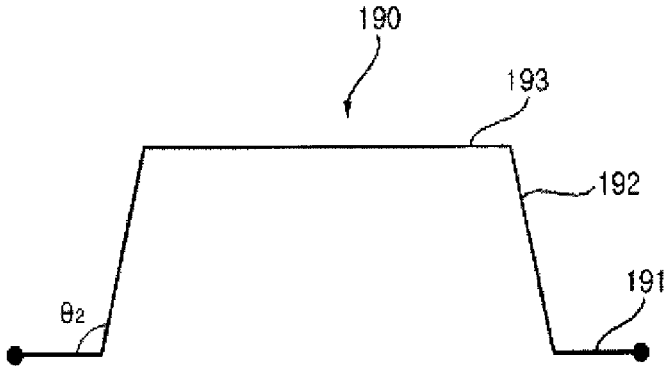
FIG. 10 is a conceptual diagram illustrating a modified example of the shape of the vibration reduction member of FIG. 9.
Figure 11:
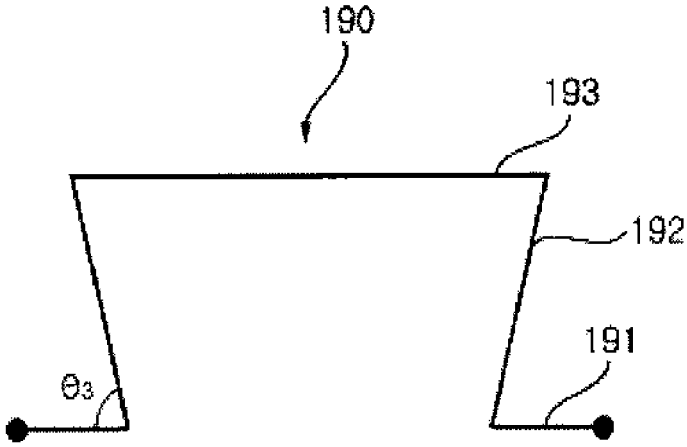
FIG. 11 is a conceptual diagram illustrating another modified example of the shape of the vibration reduction member of FIG. 9.

FIG. 9 is a conceptual diagram illustrating a shape of the vibration reduction member 190 of FIG. 6, FIG. 10 is a conceptual diagram illustrating a modified example of the shape of the vibration reduction member 190 of FIG. 9, and FIG. 11 is a conceptual diagram illustrating another modified example of the shape of the vibration reduction member 190 of FIG. 9.

Referring to FIGS. 9 to 11, each bearing coupler 193 is coupled to each connection part 192 at a predetermined angle. Further, each connection part 192 is coupled to each deforming part 191 at a predetermined angle. The predetermined angle θ is substantially a right angle θ1. Further, the predetermined angle θ is substantially an acute angle θ2. The predetermined angle θ may be substantially an obtuse angle θ3. Therefore, as each bearing coupler 193 forms the predetermined angle θ with each connection part 192, a vibration occurring in the stator 150 is efficiently removed by bending while passing through the predetermined angle θ.

Figure 12:
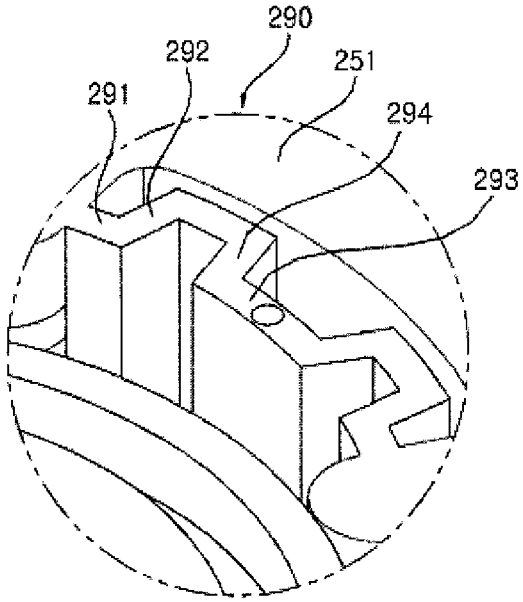
FIG. 12 is a partial perspective view illustrating a second example of the vibration reduction member of FIG. 5.

FIG. 12 is a partial perspective view illustrating a second example of the vibration reduction member of FIG. 5.

In FIG. 12, constituent elements identical to or corresponding to those according to the foregoing exemplary embodiment are denoted by the same reference numerals and therefore a detailed description thereof is omitted, and only dissimilar constituent elements are described here in detail.

Referring to FIG. 12, a coupling order of the driver 124 is identical to or similar to that described in FIGS. 5 and 6. A vibration reduction member 290 includes a plurality of bearing couplers 293 fastened to the bearing housing 170 to fix the bearing housing 170, a plurality of connection parts 292 disposed between the bodies 251 to reduce a vibration by bending, and a plurality of deforming parts 291 extended from the plurality of connection parts 292.

The plurality of connection parts 292 and the plurality of deforming parts 291 are extended by being and are coupled to bend from the bearing couplers 293. That is, the connection parts 292 are bent from the deforming part 291 to extend the deforming parts 291 to the bearing couplers 293. Further, the connection parts 292 are coupled to bend to the bearing couplers 293. Each bearing coupler 293 is coupled to each connection part 292 at a predetermined angle. Each connection part 292 is coupled to each deforming part 291 at a predetermined angle. Further, the predetermined angle is substantially a right angle.

Each connection part 292 may further include at least one recess 294 or protrusion (not shown) formed at one side of the bearing couplers 293. At least one recess 294 may be a plurality of recesses 294. At least one recess 294 is disposed between the bearing coupler 293 and the deforming part 291 and is disposed at the connection parts 292. Further, at least one recess 294 is bent. Further, when at least one recess 294 is formed in plural, each recess 294 can form a predetermined angle with another recess (not shown). When each recess 294 forms a predetermined angle with another recess, a vibration is delivered equally to or similarly to the vibration reduction member 290 of FIG. 7. That is, a vibration delivered from the connection parts 292 is gradually reduced while passing through each recess 294. Because the vibration effectively and rapidly reduces, a vibration delivered to the tub 123 is reduced.

The bearing couplers 293 are disposed on the same plane as that of a body (not shown). Therefore, the recess 294 is disposed on the same plane as that of the bearing coupler 293. The bearing couplers 293 and the body 251 may be disposed on different planes. When the connection part 292 includes at least one recess 294, at least one recess 294 is disposed on a plane lower than that of the bearing couplers 293. The connection parts 292 are disposed on a plane lower than that of at least one recess 294. Therefore, the connection parts 292 are disposed on the same plane as that of the bearing couplers 293. However, the bearing couplers 293 and the connection parts 292 may not be disposed on the same plane. That is, at least one recess 294 may be formed stepwise to be each gradually disposed on a lower plane, and the connection parts 292 may be disposed on a plane lower than that of the bearing couplers 293. The above description is equally or similarly applied to a case where at least one recess 294 is formed stepwise to be gradually disposed on a higher plane.

Figure 13:
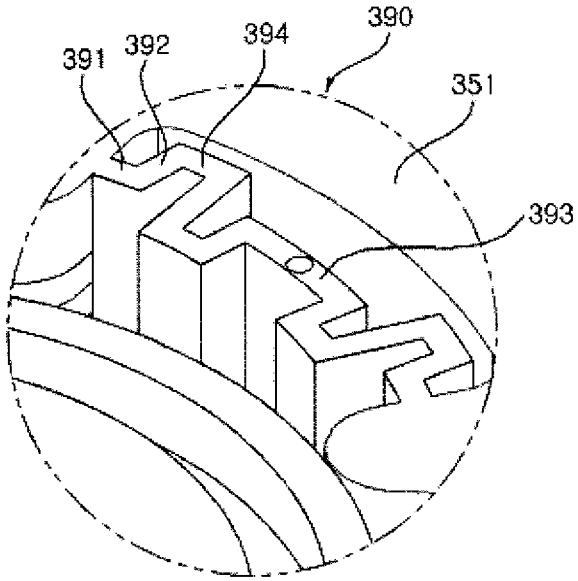
FIG. 13 is a partial perspective view illustrating a third example of the vibration reduction member of FIG. 5.

FIG. 13 is a partial perspective view illustrating a third example of the vibration reduction member 290 of FIG. 5.

In FIG. 13, constituent elements identical to or corresponding to those according to the foregoing exemplary embodiment are denoted by the same reference numerals and therefore a detailed description thereof is omitted, and only dissimilar constituent elements are described here in detail.

Referring to FIG. 13, the stator 150 includes a body 351, and a vibration reduction member 390 extended from the body 351 and integrally formed with the body 351 and to be deformed due to a load of the stator 150. The vibration reduction member 390 includes a fixed part 393 fastened to a bearing housing (not shown) to support deformation due to the load, and a free part 391 integrally formed from the fixed part 393 and reducing a load delivered from the stator 150 to the bearing housing by being deformed due to the load of the stator 150. The vibration reduction member 390 is fastened to the bearing housing at the fixed part 393. Further, because the free part 391 is coupled to bend to the body 351, a vibration occurring in the stator 150 can be effectively reduced. When the stator 150 vibrates, as described above, the free part 391 performs a function of a leaf spring. That is, as described above, when the stator 150 vibrates, the free part 391 moves vertically and laterally according to a vibration of the stator 150. When the free part 391 vibrates, the free part 391 absorbs some of a vibration of the stator 150. The free part 391 also absorbs a vibration of the bearing housing fastened to the fixed part 393. When the free part 391 absorbs a vibration of the bearing housing, the free part 391 moves vertically and laterally relative to a vibration, as described above, thereby absorbing the vibration. Therefore, a vibration of the stator 150 is absorbed by the vibration reduction member 390 and the vibration of the stator 150 is not delivered to the bearing housing.

The vibration reduction member 390 is not limited to that described above and can have a structure or an effect identical to or similar to that described in FIGS. 1 to 12.

Figure 14:
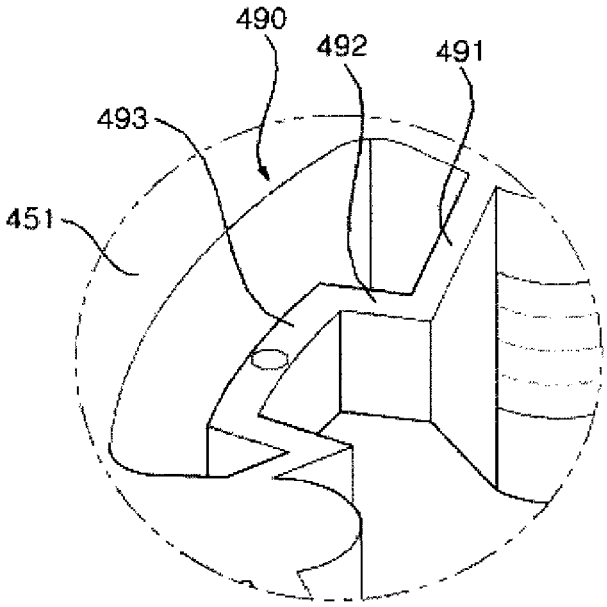
FIG. 14 is a partial perspective view illustrating a fourth example of the vibration reduction member of FIG. 5.

FIG. 14 is a partial perspective view illustrating a fourth example of the vibration reduction member 190 of FIG. 5.

In FIG. 14, constituent elements identical to or corresponding to those according to the foregoing exemplary embodiment are denoted by the same reference numerals and therefore a detailed description thereof is omitted, and only dissimilar constituent elements are described here in detail.

Referring to FIG. 14, as described above, the stator 150 includes a body 451, and a vibration reduction member 490 extended from the body 451 to be integrally formed with the body 451 and to be deformed due to a load of the stator 150. The vibration reduction member 490 includes a plurality of bearing couplers 493 fastened to the bearing housing 170 to fix the bearing housing 170, a plurality of connection parts 492 disposed between the bodies 451 and for reducing a vibration by bending, and a plurality of deforming parts 491 extended from the plurality of connection parts 492. Each deforming part 491 is formed on a plane different from that of each connection part 492. Each deforming part 491 extends from the body 451. Each deforming part 491 is extended from the body 451 at a predetermined angle. That is, each deforming part 491 is receded inwardly while forming a predetermined angle with the body 451. Further, each connection part 492 is extended from the deforming part 491. Each connection part 492 is formed on a plane different from the deforming part 491. Each connection part 492 is formed on a plane different from that of the body 451. That is, each connection part 492 is formed lower than or higher than the body 451. When each connection part 492 is formed on a plane different from that of the body 451, if the stator 150 vibrates, a vibration is prevented from being delivered to the bearing housing 170, equally or similarly to that described above. Therefore, because a vibration of the stator 150 is delivered with reduced to the bearing housing 170, noise due to the vibration of the stator 150 can be reduced.

Figure 15:
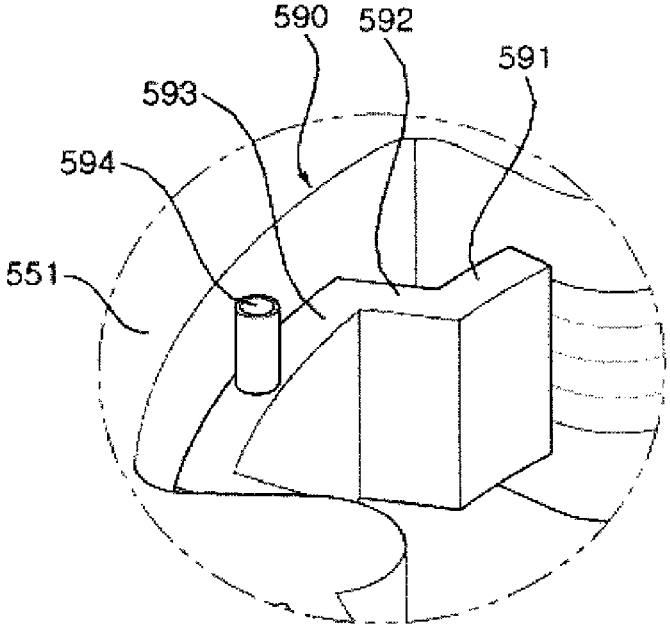
FIG. 15 is a partial perspective view illustrating a fifth example of the vibration reduction member of FIG. 5.

FIG. 15 is a partial perspective view illustrating a fifth example of the vibration reduction member 190 of FIG. 5.

In FIG. 15, constituent elements identical to or corresponding to those according to the foregoing exemplary embodiment are denoted by the same reference numerals and therefore a detailed description thereof is omitted, and only dissimilar constituent elements are described here in detail.

Referring to FIG. 15, a vibration reduction member 590 is formed identical to or similar to that described above. In this case, a plurality of bosses 594 to which the bearing housing 170 is to be fastened are formed in the vibration reduction member 590. Each boss 594 is extended from each bearing coupler 593 and is formed up to a height of a body 551. That is, each boss 594 is formed to protrude upward from each bearing coupler 593. The bearing housing 170 is fastened to each boss 594. In this case, the bearing housing 170 and each boss 594 are fastened by a screw. The vibration reduction member 590 is formed in a plane different from that of the body 551. When the vibration reduction member 590 is formed in a plane different from that of the body 551, the vibration reduction member 590 is formed to recede to the downside of the body 551. Further, the vibration reduction member 590 is formed to protrude to the upside of the body 551. Hereinafter, for convenience of description, a case where the vibration reduction member 590 is formed at a lower part of the body 551 is described.

When the vibration reduction member 590 is formed at a lower part of the body 551, the stator 150 and the bearing housing 170 are fastened by a screw to the plurality of bosses 594, as described above. Each boss 594 is formed from the bearing coupler 593 to support the bearing housing 170. When the bearing housing 170 is fastened to the each boss 594, if a vibration occurs by the stator 150, the vibration is absorbed by the bearing coupler 593, a deformed portion 591, and a connection part 592. Further, when the bearing housing 170 vibrates, a vibration is absorbed, as described above. Therefore, because the vibration reduction member 590 reduces the vibration, thereby reducing noise.

The present invention relates to a washing machine including a vibration reduction member formed in a stator for reducing a vibration occurring in a motor. Therefore, as the motor is directly fastened to the bearing housing, delivery of a vibration can be effectively reduced. Further, by reducing the vibration, noise occurring when a vibration of the motor is delivered to the tub can be reduced.

The embodiment of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A washing machine comprising:

a motor comprising a stator and a rotor;

a drum for driving by a rotation axis of the rotor;

a tub for defining a space at which the drum is disposed;

a bearing housing fixed to the tub and for housing bearings supporting the rotation axis of the rotor, wherein the stator comprises:

a body;

a vibration reduction member formed in the body to be coupled to the bearing housing and for reducing a vibration delivered from the body to the tub, wherein the vibration reduction member comprises:

a plurality of bearing couplers fastened to the bearing housing to support the stator; and a plurality of supports disposed between the bearing couplers to connect the bearing couplers and for reducing a vibration by being deformed.

2. The washing machine of claim 1, wherein the vibration reduction member is integrally formed with the body.

3. The washing machine of claim 2, wherein the plurality of bearing couplers and the plurality of supports are integrally formed.

4. The washing machine of claim 2, wherein the each bearing coupler comprises:

a bearing fastening part coupled to the bearing housing; and connection parts extended in a two-way from the bearing fastening part and connected to adjacent supports.

5. The washing machine of claim 4, wherein the connection parts are extended by bending from the bearing fastening part and are coupled to bend from the supports.

6. The washing machine of claim 2, wherein the plurality of supports and the plurality of bearing couplers are separated by a predetermined gap.

7. The washing machine of claim 2, wherein the each bearing coupler comprises at least one recess or protrusion formed at one side of the bearing coupler.

8. The washing machine of claim 2, wherein the plurality of bearing couplers are disposed on a plane different from that of the plurality of supports.

9. The washing machine of claim 2, wherein the each bearing coupler is coupled to the each support at a predetermined angle.

10. The washing machine of claim 9, wherein the each bearing coupler is coupled to the each support at substantially a right angle.

11. The washing machine of claim 2, wherein the plurality of bearing couplers comprise bosses extended to the same plane as that of the support from the bearing couplers and into which volts are inserted to couple to the bearing housing.

12. The washing machine of claim 2, wherein at least one slot is formed in the plurality of bearing couplers.

13. The washing machine of claim 2, wherein the plurality of bearing couplers are bent from the plurality of supports, are integrally formed with the plurality of supports, and are fastened and fixed to the bearing housing by a volt.

14. The washing machine of claim 1, wherein the bearing housing comprises:

a bearing support insert-injected in a rear wall of the tub and for supporting the bearing; and a stator fixing part extended in a radial direction of the rear wall of the tub from the bearing support to be coupled to the stator.

15. A washing machine comprising:

a motor comprising a stator and a rotor;

a drum for driving by a rotation axis of the rotor;

a tub for defining a space at which the drum is disposed;

a bearing housing fixed to the tub and for housing bearings supporting the rotation axis of the rotor, wherein the stator comprises:

a body;

a vibration reduction member extended from the body to be integrally formed with the body and to be deformed due to a load of the stator.

16. The washing machine of claim 15, wherein the vibration reduction member comprises:

a fixing part fastened to the bearing housing to support deformation due to the load; and a free part integrally formed with the fixing part and for reducing a load delivered from the stator to the bearing housing by being deformed due to the load of the stator.

* * * * *